US007784196B1

(12) United States Patent
Christensen et al.

(10) Patent No.: US 7,784,196 B1
(45) Date of Patent: Aug. 31, 2010

(54) ARTICLE OF FOOTWEAR HAVING AN INFLATABLE GROUND ENGAGING SURFACE

(75) Inventors: Brian Christensen, Centerville, MA (US); Paul Litchfield, Westboro, MA (US); Paul M. Davis, Blackstone, MA (US); William Marvin, Brighton, MA (US)

(73) Assignee: Reebok International Ltd., Canton, MA (US)

( * ) Notice: Subject to any disclaimer, the term of this patent is extended or adjusted under 35 U.S.C. 154(b) by 876 days.

(21) Appl. No.: 11/610,389

(22) Filed: Dec. 13, 2006

(51) Int. Cl.
*A43B 13/20* (2006.01)

(52) U.S. Cl. ..... 36/29; 36/59 R

(58) Field of Classification Search ..... 36/29, 36/61, 59 R, 134
See application file for complete search history.

(56) References Cited

U.S. PATENT DOCUMENTS

| | | | | | |
|---|---|---|---|---|---|
| 508,034 | A | | 11/1893 | Moore | |
| 547,645 | A | | 9/1895 | MacDonald | |
| 566,422 | A | | 8/1896 | Singleton | |
| 580,501 | A | | 4/1897 | Mobberley | |
| 586,155 | A | | 7/1897 | Bascom | |
| 850,327 | A | | 4/1907 | Tauber | |
| 1,010,187 | A | * | 11/1911 | Scott | 36/29 |
| 1,011,460 | A | * | 12/1911 | Maddocks | 36/29 |
| 1,069,001 | A | | 7/1913 | Guy | |
| 1,148,376 | A | | 7/1915 | Gay | |
| 1,193,608 | A | | 8/1916 | Poulson | |
| 1,198,476 | A | | 9/1916 | Pearson | |
| 1,304,915 | A | * | 5/1919 | Spinney | 36/29 |
| 1,328,154 | A | | 5/1920 | Jackerson | |
| 1,498,838 | A | * | 6/1924 | Harrison, Jr. | 36/29 |
| 1,605,985 | A | | 11/1926 | Rasmussen | |
| 1,954,122 | A | | 4/1934 | Fiori | |
| 1,979,972 | A | | 11/1934 | Guild | |
| 2,007,803 | A | | 7/1935 | Kelly | |
| 2,020,240 | A | | 11/1935 | Cochran | |
| 2,036,695 | A | | 4/1936 | Heigis | |
| 2,080,469 | A | | 5/1937 | Gilbert | |
| 2,080,499 | A | | 5/1937 | Nathansohn | |
| 2,177,116 | A | | 10/1939 | Persichino | |
| 2,488,382 | A | | 11/1949 | Davis | |
| 2,532,742 | A | | 12/1950 | Stoiner | |
| 2,600,239 | A | | 6/1952 | Gilbert | |
| 2,605,560 | A | | 8/1952 | Gouabault | |
| 2,638,690 | A | | 5/1953 | Bullard, III | |

(Continued)

FOREIGN PATENT DOCUMENTS

| | | |
|---|---|---|
| BR | 8305004 | 9/1983 |

(Continued)

*Primary Examiner*—Marie Patterson
(74) *Attorney, Agent, or Firm*—Sterne, Kessler, Goldstein & Fox P.L.L.C.

(57) ABSTRACT

An article of footwear has an upper and a sole. The sole has at least one inflatable bladder wherein said at least one inflatable bladder has an inflated state and a deflated state. A ground engaging surface of the sole has a first profile in the deflated state and a second profile in the inflated state. The first profile is different from the second profile. Varying the profile of the ground engaging surface varies the amount of cushioning in the sole so that the shoe can serve as a multipurpose shoe for activities requiring different amounts of cushioning.

41 Claims, 9 Drawing Sheets

U.S. PATENT DOCUMENTS 2,677,904 A 5/1954 Reed
2,682,712 A 8/1954 Cooksley
2,717,100 A 9/1955 Engelder
2,774,152 A 12/1956 Alber
2,863,230 A 12/1958 Cortina
2,981,010 A 4/1961 Aaskov
3,015,414 A 1/1962 Wilson
3,027,659 A 4/1962 Gianola
3,044,190 A 7/1962 Urbany
3,068,494 A 12/1962 Pinkwater
3,120,712 A 2/1964 Menken
3,221,932 A 12/1965 Anderson
3,225,463 A 12/1965 Burnham
3,331,146 A 7/1967 Karras
3,372,495 A 3/1968 Finn
3,410,004 A 11/1968 Finn
3,664,043 A 5/1972 Polumbus, Jr.
3,685,176 A 8/1972 Rudy
3,716,930 A 2/1973 Brahm
3,744,159 A 7/1973 Nishimura
3,760,056 A 9/1973 Rudy
3,854,228 A 12/1974 Conroy
3,973,336 A 8/1976 Ahn
3,995,653 A 12/1976 Mackal et al.
4,014,048 A 3/1977 Rappleyea
4,106,222 A 8/1978 Houck
4,129,951 A 12/1978 Petrosky
4,169,353 A 10/1979 Fresard
4,217,705 A 8/1980 Donzis
4,219,945 A 9/1980 Rudy
4,232,459 A 11/1980 Vaccari
4,271,606 A 6/1981 Rudy
4,358,902 A * 11/1982 Cole et al. ..... 36/28
4,361,969 A 12/1982 Vermonet
4,397,104 A 8/1983 Doak
4,417,407 A 11/1983 Fukuoka
4,446,634 A 5/1984 Johnson et al.
4,458,430 A 7/1984 Peterson
4,462,171 A 7/1984 Whispell
4,571,853 A 2/1986 Medrano
4,610,099 A 9/1986 Signori
4,628,945 A 12/1986 Johnson, Jr.
4,662,087 A 5/1987 Beuch
4,662,412 A 5/1987 Swallert
4,670,995 A 6/1987 Huang
4,700,403 A 10/1987 Vacanti
4,702,022 A 10/1987 Porcher
4,730,403 A 3/1988 Walkhoff
4,744,157 A 5/1988 Dubner
4,760,651 A 8/1988 Pon-Tzu
4,763,426 A 8/1988 Polus et al.
4,776,110 A 10/1988 Shlang
4,805,601 A 2/1989 Eischen, Sr.
4,823,482 A 4/1989 Lakic
4,856,208 A 8/1989 Zaccaro
4,873,774 A * 10/1989 Lafever ..... 36/61
4,887,367 A 12/1989 Mackness et al.
4,906,502 A 3/1990 Rudy
4,910,889 A 3/1990 Bonaventure et al.
4,912,861 A 4/1990 Huang
D314,172 S 1/1991 Whitley, II
4,991,317 A 2/1991 Lakic
4,995,173 A 2/1991 Spier
5,025,575 A 6/1991 Lakic
5,074,765 A 12/1991 Pekar
5,083,581 A 1/1992 Jaw
5,113,599 A 5/1992 Cohen et al.
5,129,107 A 7/1992 Lorenzo
5,144,708 A 9/1992 Pekar
5,155,864 A 10/1992 Walker et al.
5,155,865 A 10/1992 Walker et al.
5,155,866 A 10/1992 Walker et al.
5,158,767 A 10/1992 Cohen et al.
5,181,279 A 1/1993 Ross
5,195,254 A 3/1993 Tyng
5,230,249 A 7/1993 Sasaki et al.
5,253,435 A 10/1993 Auger et al.
5,257,470 A 11/1993 Auger et al.
5,299,369 A * 4/1994 Goldman ..... 36/61
5,343,638 A 9/1994 Legassie et al.
5,351,710 A 10/1994 Phillips
5,353,525 A 10/1994 Grim
5,392,534 A 2/1995 Grim
5,406,661 A 4/1995 Pekar
5,416,988 A 5/1995 Potter et al.
5,444,926 A 8/1995 Allen et al.
5,526,589 A * 6/1996 Jordan ..... 36/134
5,638,565 A 6/1997 Pekar
5,679,439 A * 10/1997 Schmidt et al. ..... 428/178
5,692,321 A 12/1997 Holstine
5,740,619 A * 4/1998 Broder ..... 36/61
5,765,298 A 6/1998 Potter et al.
5,771,606 A 6/1998 Litchfield et al.
5,806,208 A 9/1998 French
5,815,951 A * 10/1998 Jordan ..... 36/61
5,893,219 A 4/1999 Smith et al.
5,979,078 A 11/1999 Potter et al.
5,987,779 A 11/1999 Litchfield et al.
6,014,823 A 1/2000 Lakic
6,134,812 A 10/2000 Voss
6,161,240 A 12/2000 Huang
6,195,914 B1 3/2001 Otis
6,237,251 B1 5/2001 Litchfield et al.
6,244,666 B1 * 6/2001 O'Brien ..... 301/45
6,287,225 B1 9/2001 Touhey et al.
6,354,020 B1 3/2002 Kimball et al.
6,430,843 B1 8/2002 Potter et al.
6,505,420 B1 1/2003 Litchfield et al.
6,553,691 B2 4/2003 Huang
6,754,981 B1 * 6/2004 Edwards ..... 36/29
6,785,985 B2 9/2004 Marvin et al.
6,892,477 B2 5/2005 Potter et al.
6,915,594 B2 * 7/2005 Kim ..... 36/29
6,988,329 B2 1/2006 Marvin et al.
7,047,670 B2 5/2006 Marvin et al.
7,051,456 B2 5/2006 Swigart et al.
7,152,625 B2 12/2006 Marvin et al.
7,210,249 B2 5/2007 Passke et al.
7,234,250 B2 * 6/2007 Fogarty et al. ..... 36/61
7,254,909 B2 * 8/2007 Ungari ..... 36/61
7,437,835 B2 * 10/2008 Marvin et al. ..... 36/29
7,584,554 B2 * 9/2009 Fogarty et al. ..... 36/61
2004/0211085 A1 10/2004 Passke et al.
2005/0028404 A1 2/2005 Marvin et al.
2005/0132617 A1 6/2005 Potter et al.
2006/0162186 A1 7/2006 Marvin et al.
2006/0174518 A1 * 8/2006 Fogarty et al. ..... 36/61
2006/0272179 A1 12/2006 Passke et al.
2007/0084082 A1 4/2007 Dojan et al.
2007/0084083 A1 4/2007 Hazenberg et al.

FOREIGN PATENT DOCUMENTS

DE 3427644 1/1986
EP 229273 7/1978
EP 40189 11/1981
EP 152401 8/1985
EP 184781 6/1986
EP 389215 9/1990
EP 472110 2/1992
EP 629360 12/1994
EP 630592 12/1994
FR 2496423 6/1982
GB 520514 12/1939

| | | |
|---|---|---|
| GB | 2114425 | 8/1983 |
| GB | 2165439 | 4/1986 |
| GB | 2240254 | 7/1991 |
| GB | 2271710 | 4/1994 |
| TW | 95419 | 2/1989 |
| WO | WO 87/03789 | 7/1987 |
| WO | WO 89/10074 | 11/1989 |
| WO | WO 90/04323 | 5/1990 |
| WO | WO 91/18527 | 12/1991 |
| WO | WO 93/14659 | 8/1993 |
| WO | WO 93/21790 | 11/1993 |

* cited by examiner

ARTICLE OF FOOTWEAR HAVING AN INFLATABLE GROUND ENGAGING SURFACE

BACKGROUND OF THE INVENTION

1. Field of the Invention

This invention relates to footwear, and more particularly to an athletic shoe having an inflatable ground engaging surface.

2. Background Art

One of the problems associated with footwear, especially athletic shoes, has always been striking a balance between support and cushioning. Throughout the course of an average day, the feet and legs of an individual are subjected to substantial impact forces. Running, jumping, walking, and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot.

An athlete's stride is partly the result of energy which is stored in the flexible tissues of the foot. For example, a typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". During a typical walking or running stride, the achilles tendon and the arch stretch and contract, storing and releasing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. The discomfort for the wearer that results may diminish the incentive for further athletic activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. However, the sole should also possess enough resiliency to prevent the sole from being "mushy" or "collapsing," thereby unduly draining the energy of the wearer.

In light of the above, numerous attempts have been made to incorporate into a shoe improved cushioning and resiliency. For example, attempts have been made to enhance the natural resiliency and energy return of the foot by providing shoes with soles which store energy during compression and return energy during expansion. These attempts have included the formation of shoe soles that include springs, gels or foams such as ethylene vinyl acetate (EVA) or polyurethane (PU). However, all of these tend to either break down over time or do not provide adequate cushioning characteristics.

Another concept practiced in the footwear industry to improve cushioning and energy return has been the use of fluid-filled systems within shoe soles. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe.

However, a cushioning device which is pressurized with fluid at the factory is comparatively expensive to manufacture. Further, pressurized fluid tends to escape from such a cushioning device, requiring large molecule fluids such as Freon gas to be used as the inflating fluid. A cushioning device which contains air at ambient pressure provides several benefits over similar devices containing pressurized fluid. For example, generally a cushioning device which contains air at ambient pressure will not leak and lose air, because there is no pressure gradient in the resting state.

Athletes often need different amounts of cushioning in the soles of their shoes for different activities and consequently require a different pair of shoes for each activity. Accordingly, there is a need in the art to have a single shoe that can vary the amount of cushioning in the sole for activities requiring different amounts of cushioning.

BRIEF SUMMARY OF THE INVENTION

Disclosed herein is a sole for an article of footwear comprising at least one inflatable bladder wherein the at least one inflatable bladder has an inflated state and a deflated state. A ground engaging surface of the sole has a first profile in the deflated state and a second profile in the inflated state wherein the first profile is different from the second profile.

Also disclosed herein is an article of footwear comprising an upper and a sole wherein the sole comprises at least one inflatable bladder. The at least one inflatable bladder has an inflated state and a deflated state. A ground engaging surface of the sole has a first profile in the deflated state and a second profile in the inflated state wherein the first profile is different from the second profile.

BRIEF DESCRIPTION OF THE DRAWINGS/FIGURES

DETAILED DESCRIPTION OF THE INVENTION

Figure 1:
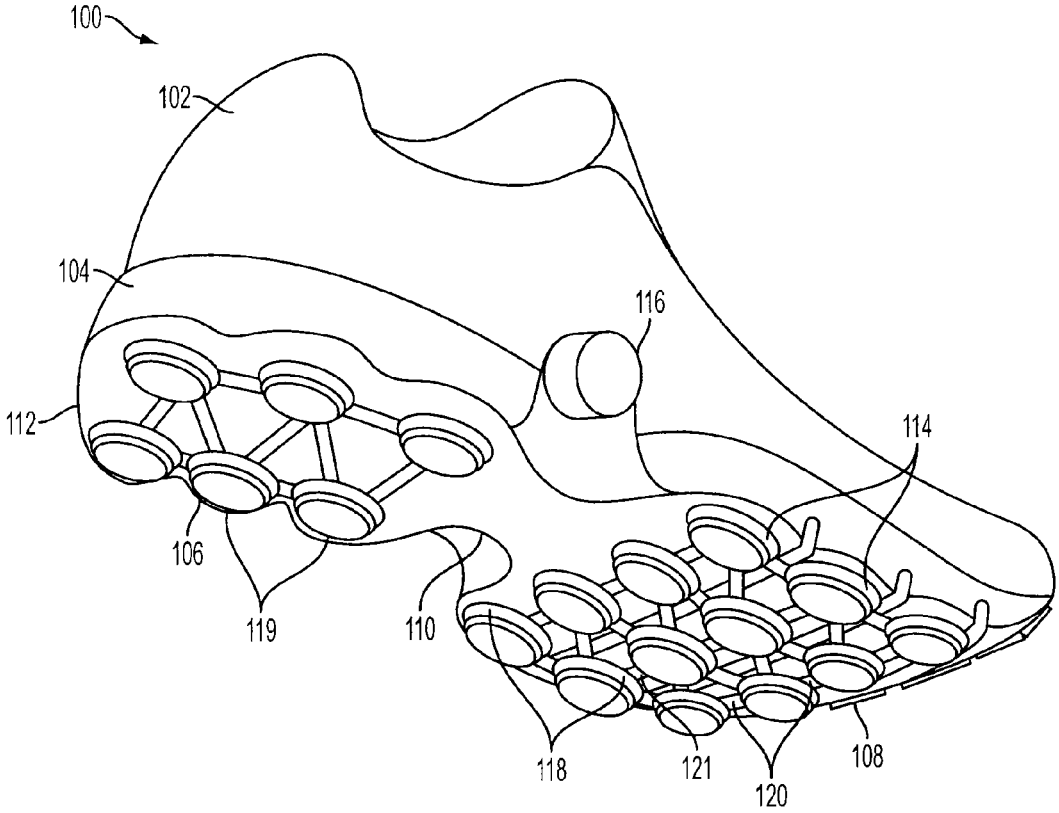
FIG. 1 is a side view of an exemplary shoe with a ground engaging surface having individual outsole pieces.

A preferred embodiment of the present invention is now described with reference to the Figures, in which like reference numerals are used to indicate identical or functionally similar elements. Also in the Figures, the left most digit of each reference numeral corresponds to the Figure in which the reference numeral first appears. While specific configurations and arrangements can be used without departing from the spirit and scope of the invention, it will be apparent to a person skilled in the relevant art that this invention can also be employed in other applications.

Disclosed herein is a shoe shown generally at 100 in FIG. 1. Shoe 100 is intended to be any type of shoe including, without limitation, an athletic shoe, a brown shoe, sandal or a dress shoe. As shown in FIG. 1, shoe 100 has an upper shown generally at 102, a sole shown generally at 104, a heel area shown generally at 106, a forefoot area shown generally at 108 and an arch area shown generally at 110. Sole 104 has a ground engaging surface 112 with an inflatable bladder 114 located above ground engaging surface 112. Inflatable bladder 114 is adjustable between an inflated state and a deflated state wherein ground engaging surface 112 has a first profile in the deflated state and a second profile in the inflated state. Inflating and deflating inflatable bladder 114 changes the profile of ground engaging surface 112 by extending at least a portion of ground engaging surface 112 away from sole 104. Shoe 100 also has an air pressure regulator 116 that regulates the air pressure in inflatable bladder 114. Air pressure regulator 116 adjusts the pressure at which air is released from inflatable bladder 114 through a pressure release valve. Air pressure regulator 116 may be adjusted so the system is fully open (no air stays in inflatable bladder 114), regulated (pressure in inflatable bladder 114 varies depending on the setting, as air is allowed to purge through the pressure release valve above the set pressure threshold), or fully closed (inflatable bladder 114 inflates to a maximum inflation pressure and no air is allowed to pass through the pressure release valve).

Figure 2:
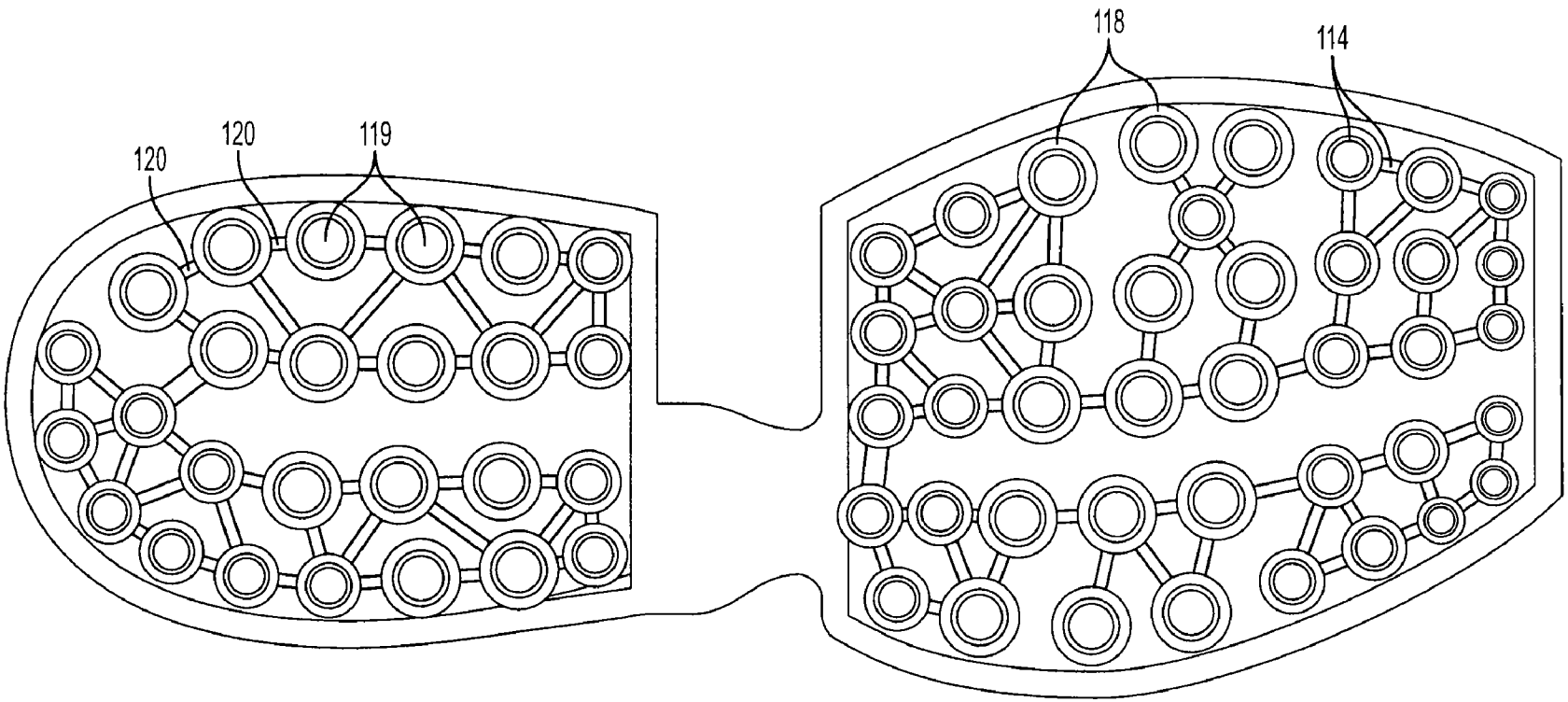
FIG. 2 is a plan view of an exemplary sole with a ground engaging surface having individual outsole pieces.
Figure 3A:
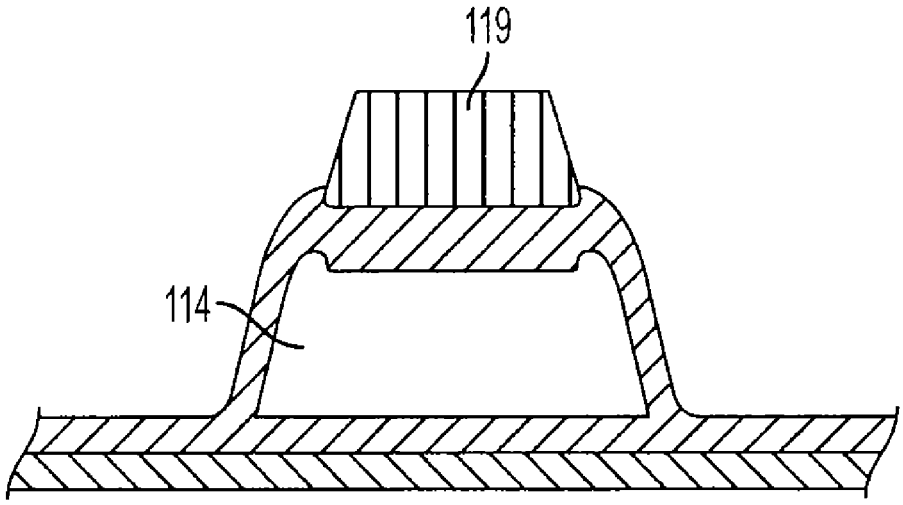
FIG. 3A is a side view of a portion of an exemplary ground engaging surface in an inflated state.
Figure 3B:
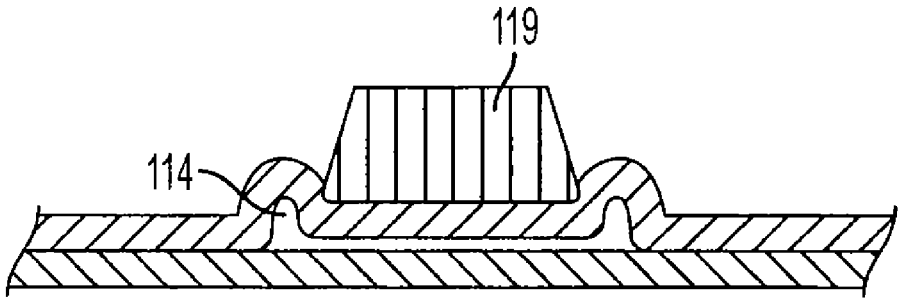
FIG. 3B is a side view of a portion of an exemplary ground engaging surface in a deflated state.

As shown in FIGS. 1 and 2, inflatable bladder 114 has a plurality of interconnected chambers 118 that are connected via conduits 120. Ground engaging surface 112 preferably comprises a plurality of individual outsole pieces 119 which are spaced apart from each other leaving gaps 121 therebetween. Inflatable bladder 114 is visible in gaps 121. At least one of the plurality of individual outsole pieces 119 extend away from sole 104 when inflatable bladder 114 inflates, thereby altering the profile of ground engaging surface 112 from a first profile in the deflated state as shown in FIG. 3B to a second profile in the inflated state as shown in FIG. 3A. Each chamber 118 has an individual outsole piece 119 associated with it that extends away from sole 104 when chamber 118 is inflated.

Figure 4:
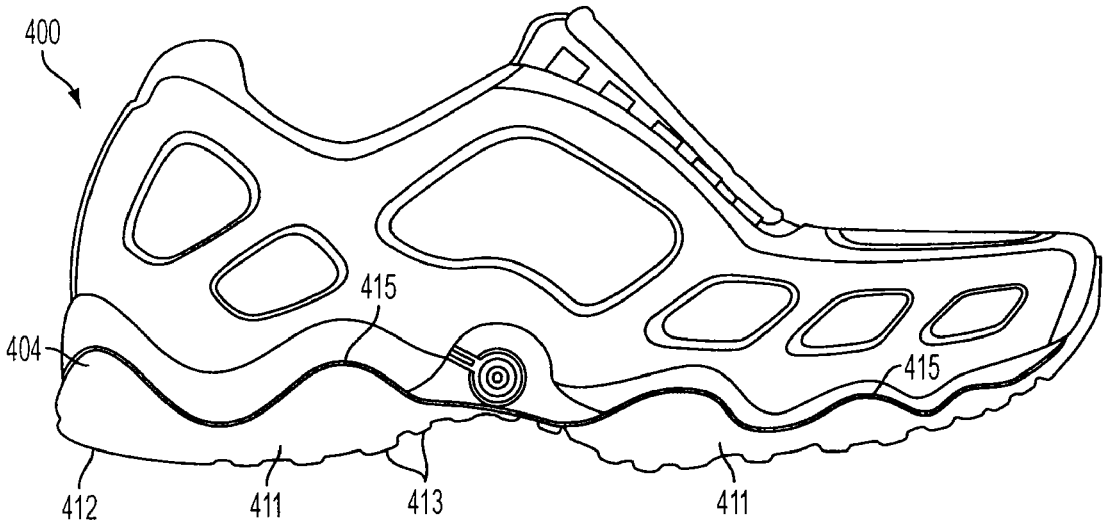
FIG. 4 is a side view of an exemplary shoe with a ground engaging surface having an outsole material.

Alternatively, as shown in FIG. 4, the ground engaging surface 412 may be an outsole 411 that substantially covers inflatable bladder 114. The outsole material may be a lightweight, flexible, and expandable material including, but not limited to rubber or cast polyurethane or a textile or suitable flexible substrate, such that when inflatable bladder 114 is inflating outsole 411 expands to accommodate the profile of inflatable bladder 114 in its inflated state. As shown in FIG. 4, the edge 415 of outsole material may wrap around and attach to a side of shoe 400 or sole 404 so that inflatable bladder 114 is not visible. Alternatively, the edge of the outsole material may be attached to inflatable bladder 114 such that inflatable bladder 114 is visible from a side view of shoe 400. The outsole material may also be a non-woven material, textile, or film layer. The outsole material may have treads or lugs 413 formed thereon through direct injection, casting, cementing, or other known methods.

Alternatively, the ground engaging surface may be the inflatable bladder. When the ground engaging surface is incorporated with the inflatable bladder, the inflatable bladder has a first surface facing the upper and a second surface that is the ground engaging surface. Treads or lugs may be applied to the ground engaging surface through direct injection, casting, cementing, or other known methods.

Figure 5:
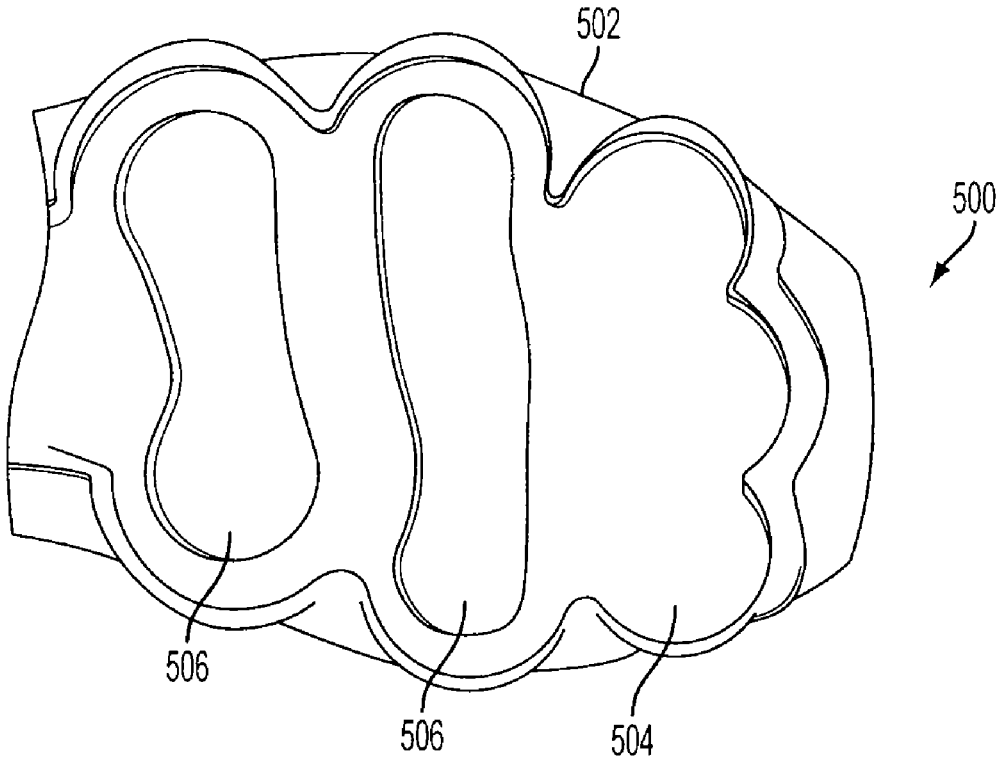
FIG. 5 is an plan view of an exemplary lower surface of a midsole.
Figure 6:
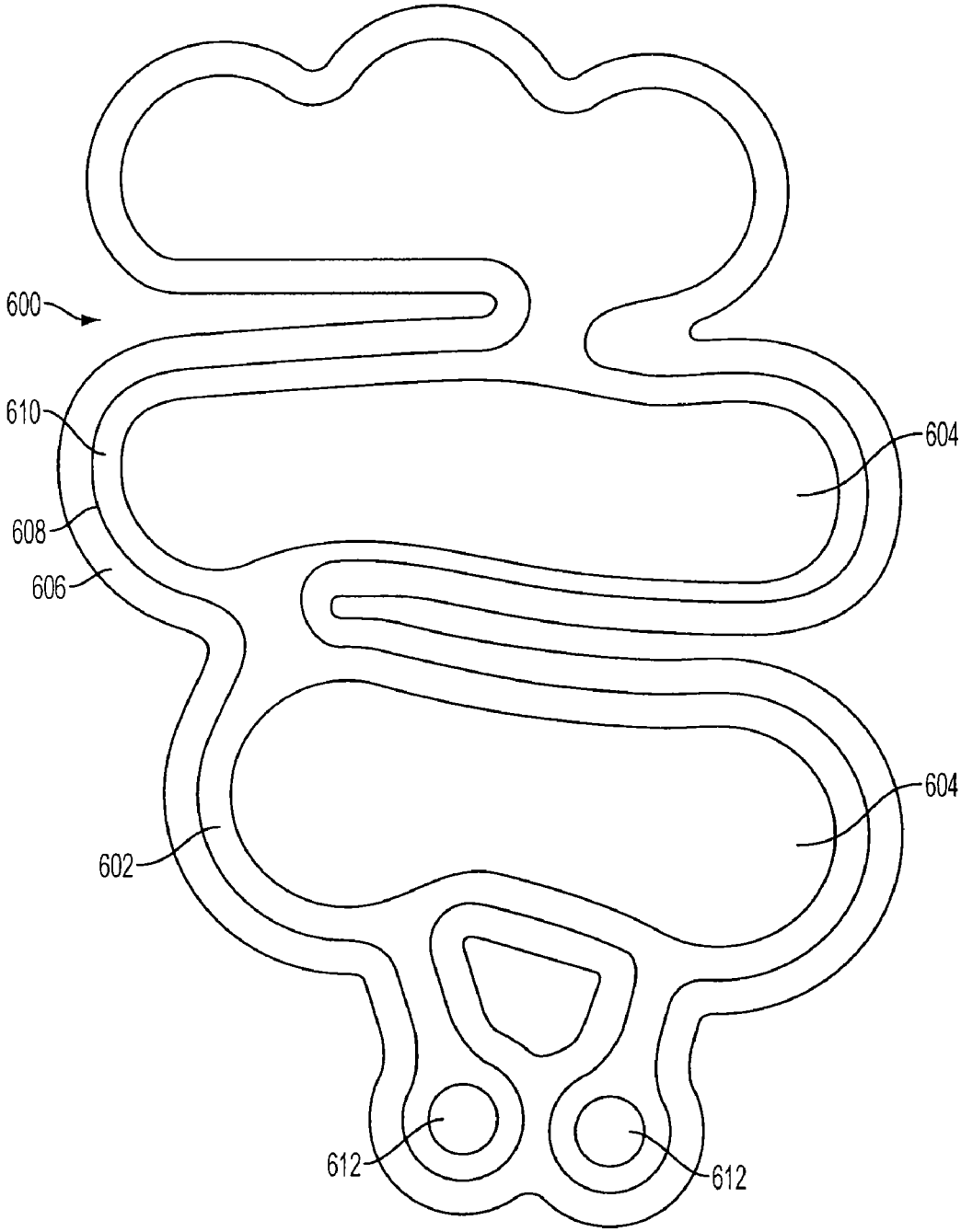
FIG. 6 is a plan view of a first surface of an exemplary inflatable bladder.

In one embodiment, the inflatable bladder is located between a lower surface of a midsole and the ground engaging surface. FIG. 5 shows an exemplary lower surface 502 of a forefoot portion of midsole 500 and FIG. 6 shows an exemplary inflatable bladder 600 for a forefoot region. Lower surface 502 of midsole 500 may have a recess 504 to correspond to a shape of inflatable bladder 600 for storing inflatable bladder 600 in its deflated state above the ground engaging surface in order to minimize the thickness of the sole when inflatable bladder 600 is in its deflated state and locate inflatable bladder 600 with respect to midsole 500. It is noted that while only the forefoot region of the lower surface of the midsole is depicted, the heel region may have a similar recess corresponding to an inflatable bladder covering the heel region.

Inflatable bladder 600 has a first surface 602 that faces midsole 500 and a second surface (not shown) that faces the ground engaging surface. Inflatable bladder 600 has a welding flange 606 with an inside edge 608 defining a boundary of at least one inflatable chamber 610. Air may enter and leave inflatable bladder 600 through barb connectors attached at locations 612. First and second surfaces of inflatable bladder 600 may be directly attached to lower surface 502 of midsole 500 or the ground engaging surface, respectively. Alternatively, either first or second surface may have one or more plates 604 attached thereto that are then attached to lower surface 502 of midsole 500 or the ground engaging surface, respectively. When first surface 602 has one or more plates 604, lower surface 502 of midsole 500 may have additional recesses 506 corresponding to the shape of plates 604 that act as locating features for mounting plates 604 to midsole 500. Plates 604 may be a polymeric material, such as thermoplastic polyurethane. Plates 604 provide a mounting surface between inflatable bladder 600 and midsole 500.

Plates 604 are strategically shaped, positioned, and made of suitable materials to control the profile of inflatable bladder 600 in its inflated state, to control the height of inflation, and locate inflatable bladder 600 with respect to midsole 500. The greater the offset between an edge of plate 604 and an edge of inflatable bladder 600, the greater the thickness of inflation. The offset can also be varied to result in a tapered thickness or offset of inflation, either an increase in thickness or offset along a length of an inflatable bladder or a decrease in thickness along a length of an inflatable bladder. For example, the offset can be varied to result in less inflated thickness at a toe of a shoe and more inflated thickness as the forefoot region curves away from the toe.

When plates 604 are present on a surface of inflatable bladder 600, portions of the surface of inflatable bladder 600 not covered by plates 604 are preferably not attached to the midsole or ground engaging surface or anything else. This allows the unattached portions of the inflatable bladder to move away from the midsole and ground engaging surface. However, there may be cases where it is preferred that certain portions of inflatable bladder 600 that are not covered by plates 604 be bonded to midsole 500, for example in the toe area or to an air transfer manifold 726.

Plates 604 are made from a polymeric material including, but not limited to, thermoplastic polyurethane. Plates 604 may be applied to inflatable bladder 600 through a variety of methods including, but not limited to, casting, silkscreen printing, or laminating through RF welding, direct injection, or cold cementing. Another exemplary method for attaching plates 604 to inflatable bladder 600 includes applying a 3 mil film of low melting temperature adhesive film to a substrate of plate material, cutting out the formed assembly to a desired shape, and then affixing the adhesive side to the inflatable bladder through conventional methods including, without limitation, RF welding or heat pressing. Subsequently plates 604 may be cold cemented or otherwise attached to the midsole or other surface.

The shoe of the present invention has at least one inflatable bladder. There can be a single inflatable bladder that spans substantially the entire sole. Alternatively, there may be a plurality of inflatable bladders, such as a first inflatable bladder for a heel area and a second inflatable bladder for a forefoot area. Other alternative embodiments with varying numbers and placements of inflatable bladders are also envisioned as would be readily apparent to a person of ordinary skill in the relevant art.

One skilled in the art would readily appreciate that the type of inflatable bladder for use in the sole/shoe of the present invention is not limited. One example of an inflatable bladder includes two films of monolayer or multilayer sealable thermoplastic material through which air may not readily pass. Furthermore, the two sealable thermoplastic films may be a multilayer laminate of film and fabric or of film and a nonwoven material. The two films utilized to form the inflatable bladder may be the same material or different materials such as a monolayer film and a multilayer laminate. The films of different materials may be cast or coextruded to form the inflatable bladder. An exemplary film includes an outer layer of 12 mil polyester urethane of 50 D Shore hardness, a scrim layer, and an inner layer of 8 mil polyester urethane of 95 A Shore hardness. The material for the scrim layer is present to increase puncture resistance and to increase the tensile strength and may include, but is not limited to, 210 denier nylon of high tenacity or polyester. The outer layer material should be of suitable thickness and hardness to increase puncture resistance of the bladder. The inner layers face each other in an assembled inflatable bladder.

The films are sealed around a periphery to form the inflatable bladder. In a preferred embodiment the majority of the peripheral seal is on an inside of the inflatable bladder. Such an inflatable bladder can be made wherein the two films are positioned on top of each other and welded or otherwise sealed along a plurality of the peripheral edges leaving at least one peripheral edge unsealed. The two films are then turned inside out such that the seal is in the interior of the inflatable bladder. Then the remaining peripheral edge(s) is welded or otherwise sealed together to form the inflatable bladder. Alternatively, the peripheral seal is on an outside of the inflatable bladder wherein the two films are positioned on top of each other and welded or otherwise sealed along the peripheral edges. The welding or sealing may include, but is not limited to, RF welding or heat sealing. Inflatable bladders can be shaped to have a plurality of interconnected inflatable chambers 118 with conduits 120 in between as shown in FIGS. 1 and 2. A plurality of interconnected inflatable chambers can be formed by thermoforming the films and welding or otherwise sealing the films together at areas other than the periphery.

The ground engaging surface may be a variety of materials and may have a variety of forms. The ground engaging surface shown in FIGS. 1 and 2 with individual outsole pieces 119 can be made from a variety of methods as would be readily apparent to a person of ordinary skill in the relevant art. For example, the ground engaging surface can have the gap areas scored prior to attaching the ground engaging surface to the inflatable bladder. Inflatable bladder 114 may be attached with an adhesive that is screen printed or otherwise applied in a pattern such that the scored areas of the ground engaging surface can be removed after attachment. Alternatively the individual outsole pieces 119 can be individually attached to the bladder with an adhesive. In such an instance, the pieces that extend away from the sole when the bladder is inflated and the pieces that stay in place may be made of different materials.

Alternatively, the ground engaging surface may be an outsole material that is lightweight, flexible, stretchable, and expandable material including, but not limited to cast polyurethane, such that when an inflatable bladder is inflating the outsole material stretches and expands to accommodate the profile of inflatable bladder in its inflated state. The ground engaging surface may also be the inflatable bladder, a nonwoven material, a textile, or a film. When the ground engaging surface is incorporated with an inflatable bladder, the inflatable bladder has a first surface facing the upper and a second surface that is the ground engaging surface. Any of these ground engaging surfaces may have treads or lugs applied thereto through direct injection, casting, cementing, or other known methods. The treads or lugs may be applied in a discontinuous manner and may move with the ground engaging surface to form different profiles based on the inflation level of the inflatable bladder.

Figure 7:
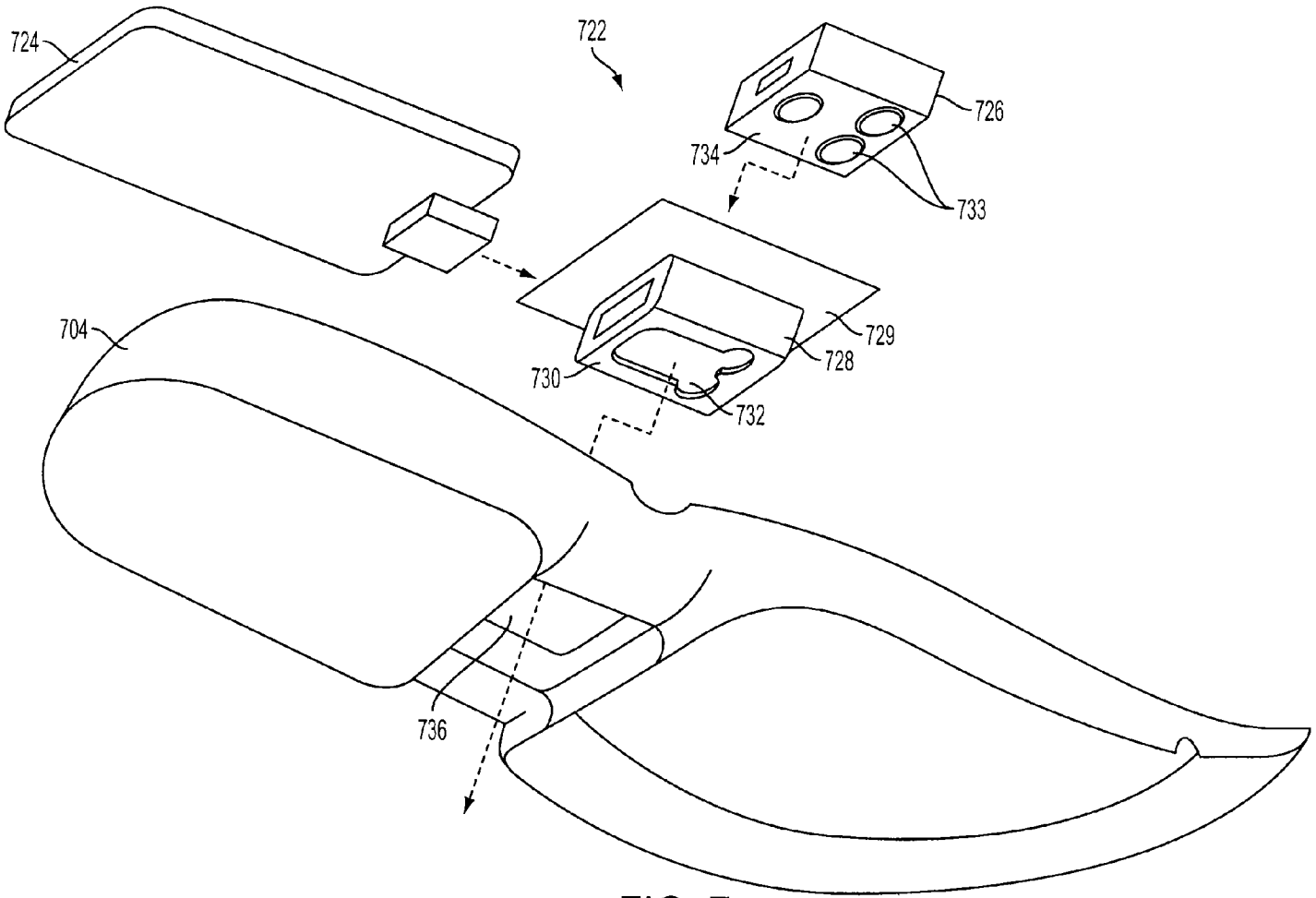
FIG. 7 is an exploded view of an exemplary inflation mechanism and air transfer manifold incorporated into an exemplary sole.
Figure 8:
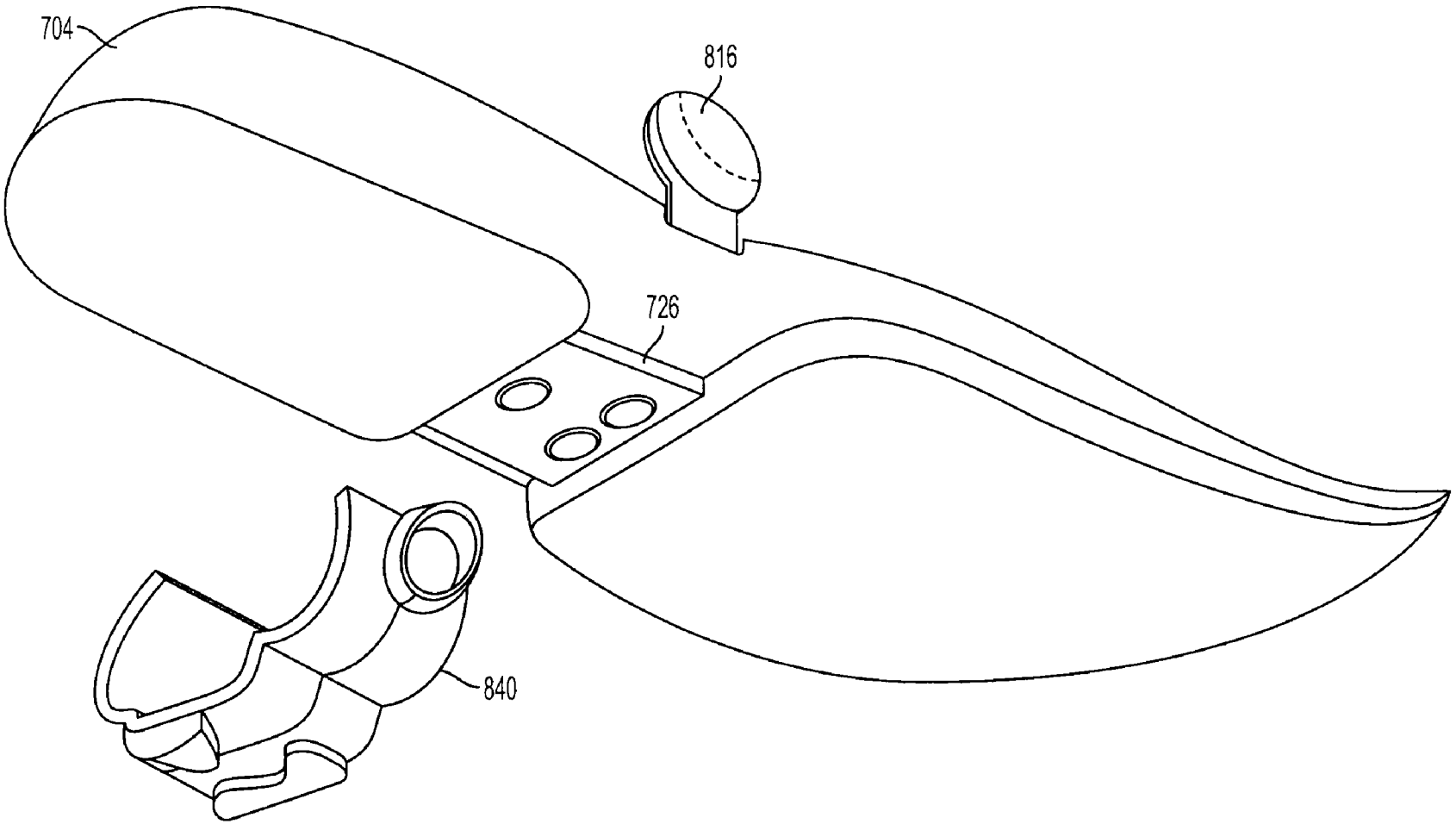
FIG. 8 is an exploded view of an exemplary air pressure regulator incorporated into an exemplary sole.
Figure 9:
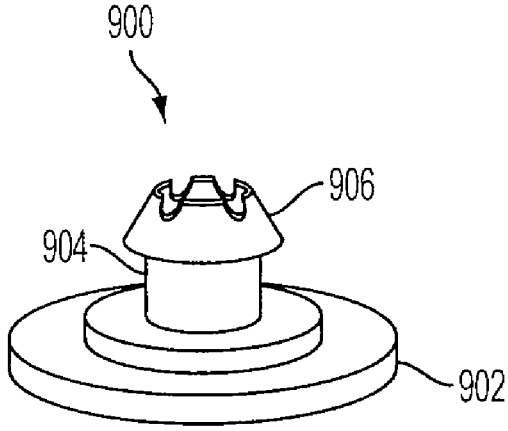
FIG. 9 is a perspective side view of an exemplary barb connector.

In order for a wearer to customize the amount of air in a bladder the bladder is placed in fluid communication with an inflation mechanism and an air pressure regulator. FIGS. 7-8 illustrate an exemplary arrangement of an inflation mechanism generally shown at 722. Inflation mechanism 722 consists of an underfoot pump 724 fluidly connected to a manifold 726, which sits in a manifold seating 728. Preferably underfoot pump 724, manifold seating 728 and manifold 726 are injection molded from a polymeric material including, but not limited to, thermoplastic polyurethane, although other methods of formation may be used as would be apparent to a person of ordinary skill in the relevant art. Manifold seating 728 has a bottom surface 730 with an opening 732 that allows access to a plurality of openings 733 in bottom surface 734 of manifold 726. Underfoot pump 724 sits in an indentation (not shown) on the upper surface of sole 704. It is noted that while underfoot pump 724 is shown located in a heel region, it can be located anywhere along sole 704. Sole 704 has an opening 736 for receiving manifold 726 and manifold seating 728 such that a flange 729 of manifold seating 728 prevents manifold 726 and manifold seating 728 from falling through opening 736. Alternatively, manifold 726 may have a peripheral flange that rests against an upper surface of sole 704 to prevent manifold 726 from falling through opening 736, thereby eliminating the need for manifold seating 728. A bottom surface 734 of manifold 726 and manifold seating 728 are flush with opening 736 in sole 704. Openings 733 on bottom surface 734 of manifold 726 are accessible for receiving barb connectors, as shown generally at 900 in FIG. 9, of bladders to fluidly connect the bladders to underfoot pump 724 via manifold 726. Barb connector 900 has a flange 902, a body 904 extending from flange 902, and at least one conical barb 906 at an end of body 904 opposite flange 902.

A bladder may be fluidly connected to one of openings 733 in bottom surface 734 of manifold 726 via a barb connector 900 or other means. The bladder arrangement may include, but is not limited to, a forefoot bladder and a heel bladder or any other arrangement that would have been apparent to a person of ordinary skill in the relevant art.

Air enters inflation mechanism 722 through an air intake hole (not shown) in underfoot pump 724 and passes through a one-way valve (not shown) into manifold 726 when underfoot pump 724 is compressed The air intake hole may have an air intake valve and a filter material that prevents moisture and debris from entering into the system. The one-way valve prevents air from flowing back into underfoot pump 724. Manifold 726 has one or more pathways that direct the air into the bladder, thereby inflating it. The pathways may include flow restrictors locate therein or adjacent entrances to the pathways that limit the airflow to prevent an inflatable heel bladder from being inflated too quickly, thereby eliminating tears in the bladder, and reducing backflow pressures.

Figure 10:
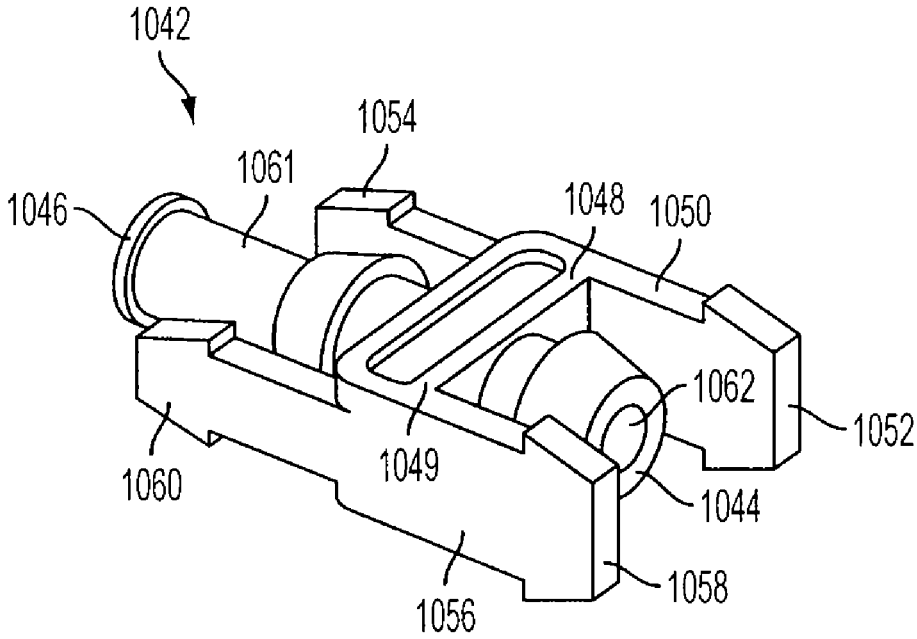
FIG. 10 is a perspective view of an exemplary one-way valve for use in an exemplary inflation mechanism.

An exemplary one-way valve is shown generally at 1042 in FIG. 10. One-way valve 1042 is preferably a molded piece of a smooth, nonporous material including, but not limited to, polycarbonate that is inserted between underfoot pump 724 and manifold 726. One-way valve 1042 is generally cylindrical in shape and has a first end 1044 and a second end 1046. A first extension 1048 and a second extension 1049 extend perpendicularly from an axis of the body of one-way valve 1042 on opposite sides from each other. A first connector arm 1050 with a first end 1052 and a second end 1054 extends from first extension 1048 substantially parallel to the cylindrical body and a second connector arm 1056 with a first end 1058 and a second end 1060 extends from second extension 1049 substantially parallel to the cylindrical body. There is at least one air outlet opening (not shown) along a circumference of the cylindrical body adjacent second end 1046 of one-way valve 1042. An elastomeric sleeve 1061 surrounds the outlet opening. First end 1044 of one-way valve 1042, first end 1052 of first connector arm 1050 and first end 1058 of second connector arm 1056 are inserted into an air fitment receptacle (not shown) of underfoot pump 724 such that first and second extension 1048, 1049 abut the air fitment receptacle. Second end 1046 of one-way valve 1042, second end 1054 of first connector arm 1050 and second end 1060 of second connector arm 1056 are inserted into openings in manifold 726 such that manifold 726 abuts first and second extensions 1048, 1049.

When underfoot pump 724 is compressed, air flows into an opening 1062 in first end 1044 of one-way valve 1042 and through the valve body to opening 1062. The force of the air pushes against elastomeric sleeve 1061 covering the outlet opening causing it to expand allowing air to escape out the outlet opening past elastomeric sleeve 1061 and into manifold 726. When the pressure is released from underfoot pump 724, elastomeric sleeve 1061 returns to its original, unexpanded state such that air can not flow back into valve 1042 or into underfoot pump 724.

Inflation mechanism 722 described above, is merely exemplary and a variety of other inflation mechanisms can be utilized in the present invention. The inflation mechanism may be an on-board inflation mechanism, for example, a latex bulb which is physically attached to a part of the sole/shoe. Alternatively, the inflation mechanism may be a molded plastic chamber or may be a hand held pump such as one which utilizes $CO_2$ gas to inflate a bladder. Alternatively, the inflation mechanism may be a portion of a monolithic bladder that is separated from the remainder of the bladder. The isolated portion fluidly communicates with the remainder of the bladder via a one-way valve. The one-way valve allows the isolated portion to act as an inflation mechanism. These alternative inflation mechanisms are described more fully, for example, in U.S. Pub. No. 2006/0162186, which is incorporated herein by reference.

Each alternative inflation mechanism requires a one-way valve to be present between the inflation mechanism and the inflatable bladder so that once air enters the inflatable bladder it may not travel backwards into the inflation mechanism. Various types of one-way valves are suitable for use in conjunction with the various alternative inflation mechanisms such as that described more fully in U.S. Pub. No. 2006/0162186, which is incorporated herein by reference.

The inflatable bladder inflated by the inflation mechanism may be fluidly connected to other inflatable bladders located throughout the shoe such that the inflation of one inflatable bladder may in turn inflate other inflatable bladders. Each inflatable bladder may have its own check valve and/or air pressure regulator.

FIG. 8 illustrates an embodiment wherein pressure regulator 116 is fluidly connected to a bladder via manifold 726. A protective cover 840 covers and protects bottom surface 734 of manifold 726 and wraps around a medial or lateral side of sole 704 to surround pressure regulator 816. The material for protective cover 840 may include, without limitation, thermoplastic polyurethane or glass-filled nylon. Pressure regulator 816 may comprise an adjustable knob for setting a desired pressure at which the inflatable bladder is to be maintained. The adjustable knob may be adjustable according to ordinary means including, but not limited to, rotating or sliding. For example, the adjustment may be made over a pressure range of 0 to 20 psi. Additional air present in the system bleeds off when the desired pressure is present and pressure regulator 816 will not allow the bladder to be inflated beyond the desired pressure no matter how much a user attempts to inflate the shoe. Pressure regulator 816 may also contain a provision to allow the inflatable bladder to deflate completely or not inflate at all when the desired pressure is set to 0.0 psi or through actuation of an alternative pressure regulator. A flip top may be used to access pressure regulator 816 as described in U.S. patent application Ser. No. 11/475,254, filed Jun. 27, 2006, which is incorporated herein by reference. The above described pressure regulator is merely exemplary and other pressure regulators could be used, such as a release valve, a check valve or a combination check valve and release valve, as described in U.S. Pub. No. 2006/0162186, which is incorporated herein by reference.

The shoe disclosed herein has an inflatable ground engaging surface, which allows the user to change the profile of the ground engaging surface by inflating and deflating the inflatable bladder(s) as desired depending upon the activity the wearer is going to engage in.

As noted elsewhere, these example embodiments have been described for illustrative purposes only, and are not limiting. Other embodiments are possible and are covered by the methods and systems described herein. Such embodiments will be apparent to persons skilled in the relevant art(s) based on the teachings contained herein. Thus, the breadth and scope of the methods and systems described herein should not be limited by any of the above-described exemplary embodiments, but should be defined only in accordance with the following claims and their equivalents.

What is claimed is:

1. A sole for an article of footwear, the sole comprising:

at least one inflatable bladder comprising a first film and a second film sealed to said first film, wherein said at least one inflatable bladder has an inflated state and a deflated state; and a ground engaging surface having a first profile in said deflated state and a second profile in said inflated state, wherein said first profile is different from said second profile, the ground engaging surface comprising a plurality of outsole pieces, wherein said at least one inflatable bladder is visible in between said outsole pieces.

2. The sole of claim 1, wherein at least one of said plurality of individual outsole pieces extend away from the sole when said at least one inflatable bladder is in said inflated state.

3. The sole of claim 2, further comprising a midsole wherein said midsole has a lower surface that is recessed to correspond to a shape of said at least one inflatable bladder for storing said at least one inflatable bladder in said deflated state.

4. The sole of claim 2, wherein said at least one inflatable bladder comprises a plurality of interconnected chambers.

5. The sole of claim 4, wherein each of said chambers is located above one of said plurality of individual pieces that extend away from the sole when said at least one inflatable bladder is in said inflated state.

6. The sole of claim 1, wherein said at least one inflatable bladder comprises a plurality of interconnected chambers.

7. The sole of claim 1, wherein said at least one inflatable bladder comprises:

a first inflatable bladder positioned in a forefoot region of said sole; and a second inflatable bladder positioned in a heel region of said sole.

8. The sole of claim 7, wherein said first inflatable bladder comprises a plurality of interconnected chambers.

9. The sole of claim 7, wherein said second inflatable bladder comprises a plurality of interconnected chambers.

10. The sole of claim 1, wherein said at least one inflatable bladder is positioned in a forefoot region of said sole.

11. The sole of claim 1, wherein said at least one inflatable bladder is positioned in a heel region of said sole.

12. The sole of claim 1, further comprising;

at least one plate having a first surface and a second surface, wherein said second surface is attached to a surface of said at least one inflatable bladder; and a midsole having a lower surface, wherein said lower surface is attached to said first surface of said at least one plate.

13. The sole of claim 12, wherein said lower surface of said midsole is recessed to correspond to a shape of said at least one inflatable bladder and said at least one plate for storing said at least one inflatable bladder and said at least one plate in said deflated state.

14. The sole of claim 1, wherein said sole has an opening for holding a manifold.

15. A sole for an article of footwear, the sole comprising:

at least one inflatable bladder comprising a first film and a second film sealed to said first film, wherein said at least one inflatable bladder has an inflated state and a deflated state; and a ground engaging surface comprising an outsole having a first profile in said deflated state and a second profile in said inflated state, wherein said first profile is different from said second profile in that at least a portion of said outsole expands to accommodate said at least one inflatable bladder when said at least one inflatable bladder moves from said deflated state to said inflated state.

16. The sole of claim 15, further comprising a midsole wherein said midsole has a lower surface that is recessed to correspond to a shape of said at least one inflatable bladder for storing said at least one inflatable bladder in said deflated state.

17. The sole of claim 15, wherein said at least one inflatable bladder comprises a plurality of interconnected chambers.

18. The sole of claim 15, wherein said at least one inflatable bladder comprises:

a first inflatable bladder positioned in a forefoot region of said sole; and a second inflatable bladder positioned in a heel region of said sole.

19. The sole of claim 18, wherein said first inflatable bladder comprises a plurality of interconnected chambers.

20. The sole of claim 18, wherein said second inflatable bladder comprises a plurality of interconnected chambers.

21. The sole of claim 15, wherein said at least one inflatable bladder is positioned in a forefoot region of said sole.

22. The sole of claim 15, wherein said at least one inflatable bladder is positioned in a heel region of said sole.

23. The sole of claim 15, wherein an edge of said outsole is attached to said at least one inflatable bladder.

24. The sole of claim 15, wherein an edge of said outsole is attached to a midsole located above said at least one inflatable bladder.

25. The sole of claim 15, further comprising:

at least one plate having a first surface and a second surface, wherein said second surface is attached to a first surface of said at least one inflatable bladder; and a midsole having a lower surface, wherein said lower surface is attached to said first surface of said at least one plate.

26. The sole of claim 25, wherein said lower surface of said midsole is recessed to correspond to a shape of said at least one inflatable bladder and said at least one plate for storing said at least one inflatable bladder and said at least one plate in said deflated state.

27. The article of footwear of claim 15, wherein said sole has an opening for a manifold.

28. An article of footwear comprising:

an upper; and a sole comprising:

at least one inflatable bladder, wherein said at least one inflatable bladder has an inflated state and a deflated state;

a ground engaging surface of said sole has a first profile in said deflated state and a second profile in said inflated state, wherein said first profile is different from said second profile; and an opening in a top surface;

a manifold located in said opening in said top surface of said sole, wherein said at least one inflatable bladder is fluidly connected to said manifold; and an underfoot pump fluidly connected to said manifold that sends air through said manifold and into said at least one inflatable bladder for inflating said at least one inflatable bladder.

29. The article of footwear of claim 28, further comprising:

a pressure regulator.

30. The article of footwear of claim 29, wherein said pressure regulator regulates pressure in said at least one inflatable bladder and bleeds off air when the pressure meets a threshold value.

31. The article of footwear of claim 29, wherein said pressure regulator is fluidly connected to said manifold.

32. A sole for an article of footwear, the sole comprising:

at least one inflatable bladder comprising a first film and a second film sealed to said first film, wherein said at least one inflatable bladder has an inflated state and a deflated state;

a ground engaging surface comprising said at least one inflatable bladder, said ground engaging surface having a first profile in said deflated state and a second profile in said inflated state, wherein said first profile is different from said second profile; and a midsole, wherein said midsole has a lower surface that is recessed to correspond to a shape of said at least one inflatable bladder for storing said at least one inflatable bladder in said deflated state.

33. The sole of claim 32, wherein said at least one inflatable bladder comprises a plurality of interconnected chambers.

34. The sole of claim 32, wherein said at least one inflatable bladder comprises:

a first inflatable bladder positioned in a forefoot region of said sole; and a second inflatable bladder positioned in a heel region of said sole.

35. The sole of claim 34, wherein said first inflatable bladder comprises a plurality of interconnected chambers.

36. The sole of claim 34, wherein said second inflatable bladder comprises a plurality of interconnected chambers.

37. The sole of claim 32, wherein said at least one inflatable bladder is positioned in a forefoot region of said sole.

38. The sole of claim 32, wherein said at least one inflatable bladder is positioned in a heel region of said sole.

39. The sole of claim 32, further comprising;

at least one plate having a first surface and a second surface, wherein said first surface is attached to said lower surface of said midsole and said second surface is attached to a surface of said at least one inflatable bladder.

40. The sole of claim 39, wherein said lower surface of said midsole is recessed to correspond to a shape of said at least one inflatable bladder and said at least one plate for storing said at least one inflatable bladder and said at least one plate in said deflated state.

41. The sole of claim 32, wherein said sole has an opening for holding a manifold.

* * * * *